US011219988B2

(12) United States Patent
Cheng et al.

(10) Patent No.: US 11,219,988 B2
(45) Date of Patent: Jan. 11, 2022

(54) TUBULAR TOOL

(71) Applicants: Chin-Shun Cheng, Taichung (TW); Han-Yang Cheng, Taichung (TW)

(72) Inventors: Chin-Shun Cheng, Taichung (TW); Han-Yang Cheng, Taichung (TW)

( * ) Notice: Subject to any disclaimer, the term of this patent is extended or adjusted under 35 U.S.C. 154(b) by 391 days.

(21) Appl. No.: 16/293,662

(22) Filed: Mar. 6, 2019

(65) Prior Publication Data

US 2020/0282529 A1 Sep. 10, 2020

(51) Int. Cl.
*B25B 13/58* (2006.01)
*B25B 13/06* (2006.01)

(52) U.S. Cl.
CPC ..... *B25B 13/58* (2013.01); *B25B 13/06* (2013.01)

(58) Field of Classification Search
CPC ..... B25B 13/58
See application file for complete search history.

(56) References Cited

U.S. PATENT DOCUMENTS 6,520,509 B1 * 2/2003 Vasudeva ..... B23B 31/1071 279/14
9,463,559 B1 * 10/2016 Chan ..... B25G 1/043
2009/0019973 A1 * 1/2009 Nieh ..... B25B 13/06 81/124.1

* cited by examiner

*Primary Examiner* — Hadi Shakeri

(57) ABSTRACT

A tubular tool includes a tubular first part and a tubular second part. The tubular first part including a first section having an engaging hole defined in the distal end thereof, and a second section having a connection hole defined in the distal end thereof so as to be respectively connected to a driving tool and an object. The tubular second part is rotatably mounted to the first outer periphery of the first section of the first part. At least one lip extending from the inner periphery of the tubular second part. At least one first circular rib extends outward from the first outer periphery of the first section. The at least one lip is engaged with the at least one first circular rib to restrict the second part from separating from the first prat.

12 Claims, 18 Drawing Sheets

TUBULAR TOOL

BACKGROUND OF THE INVENTION

1. Fields of the Invention

The present invention relates to a tool, and more particularly, to a tubular tool to be connected with a driving tool and an object which is rotated by rotating the tubular tool.

2. Descriptions of Related Art

The conventional tubular tool as disclosed in FIG. 23 includes a socket 30 and a sleeve 40, wherein the socket 30 includes a hexagonal engaging hole 31 and the sleeve 40 includes a mounting hole 41 in which the outer periphery 32 of the socket 30 is snugly inserted. However, the wall thickness of the socket 30 that is located corresponding to the engaging hole 31 affects torque and strength that the socket 30 can be applied. When the wall is thick, the total weight increases although a higher torque can be applied. On the contrary, when the wall is thin, although the total weight decreases, the socket 30 cannot be applied with a higher torque. The inner periphery of the mounting hole 41 of the sleeve 40 is designed to be tightly engaged with the outer periphery 32 of the socket 30, that is to say, the sleeve 40 cannot rotated relative to the socket 30, nevertheless, it is possible that the sleeve 40 is separated from the socket 30 after a period of time of use.

The present invention intends to provide a tubular tool that balances requirements of light in weight and high torque operation.

SUMMARY OF THE INVENTION

The present invention relates to a tubular tool and comprises a tubular first part including a first section and a second section which is located opposite to the first section. The first section has an engaging hole defined in the distal end thereof. The second section has a connection hole defined in the distal end thereof. At least one first circular rib extends outward from a first outer periphery of the first section. A tubular second part includes a mounting hole defined axially therethrough, and at least one lip extends inward from the inner periphery of the tubular second part. The tubular second part is rotatably mounted to the first outer periphery of the first section of the first part. The at least one lip is engaged with the at least one first circular rib to restrict the second part from separating from the first prat.

The primary object of the present invention is to provide a tubular tool wherein the first circular ribs increase the wall thickness of the engaging hole while the diameter of the first section is reduced, so that the tubular tool operates under high torque and the weight is reduced.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
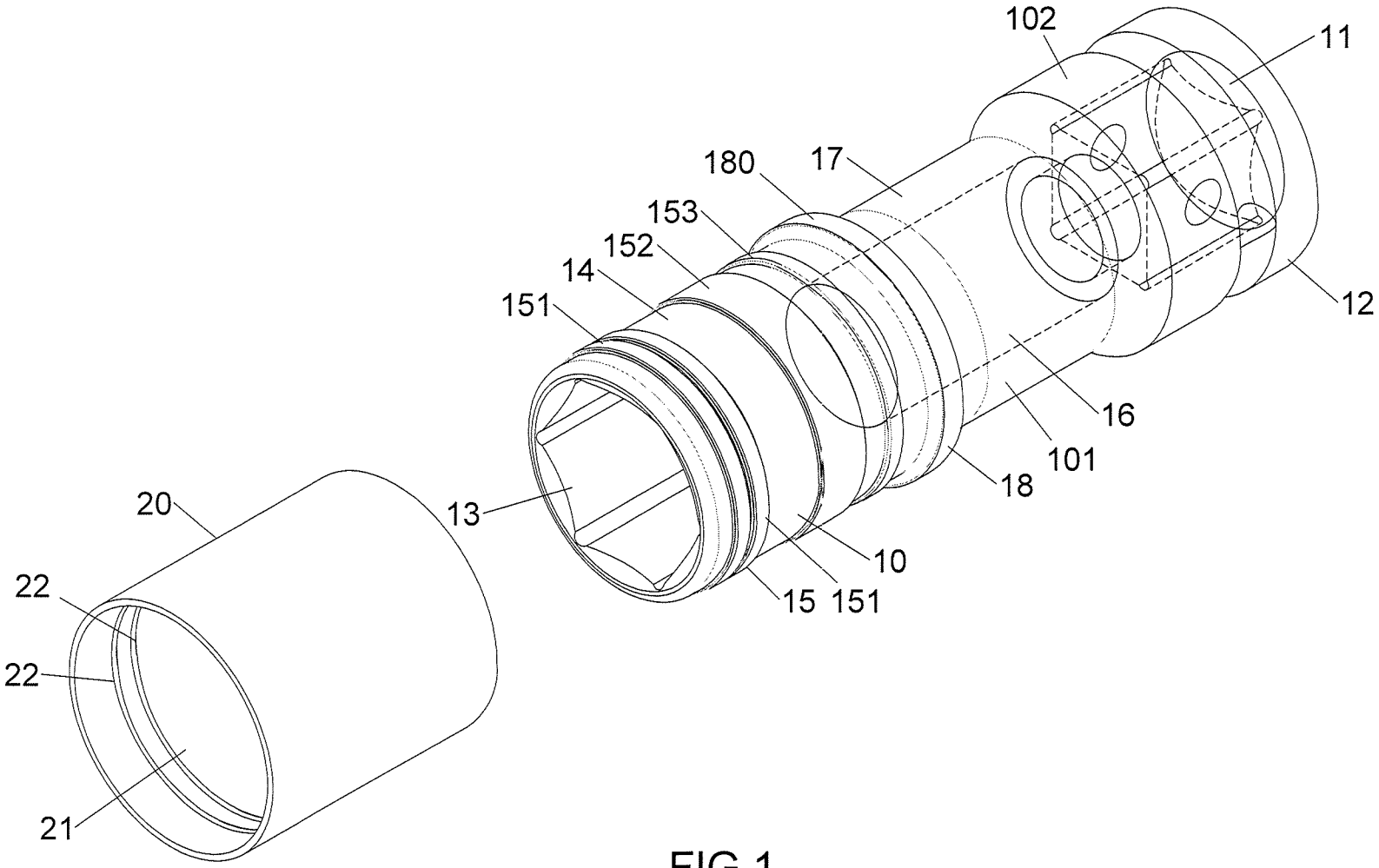
FIG. 1 is an exploded view of the tubular tool of the present invention.
Figure 4:
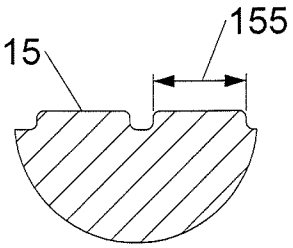
FIG. 4 is an enlarged view of the area "B" in FIG. 4.
Figure 3:
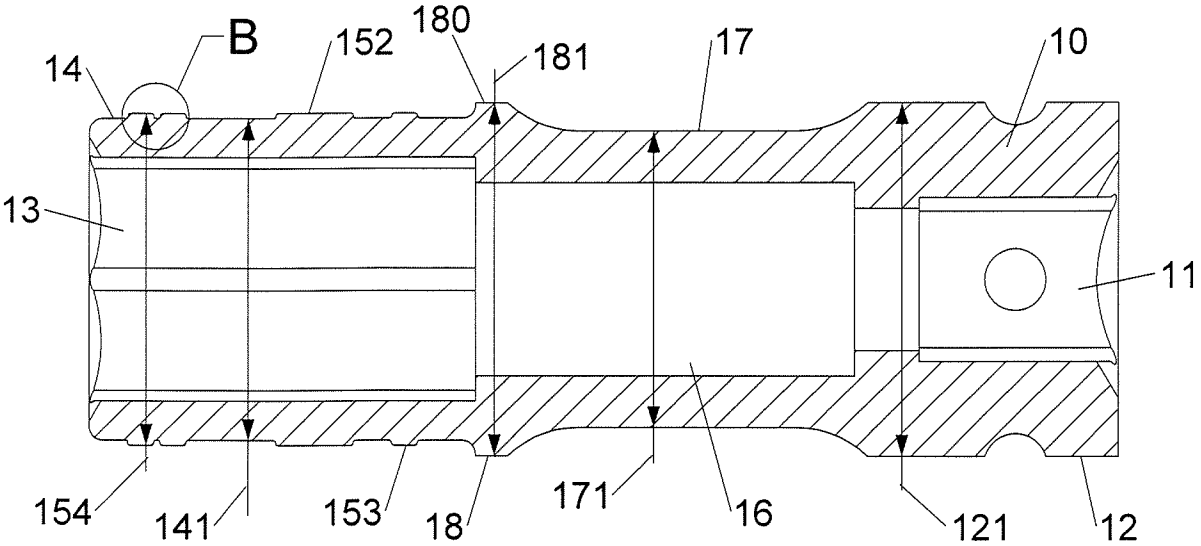
FIG. 3 is a cross sectional view, taken along line A-A of FIG. 2.
Figure 2:
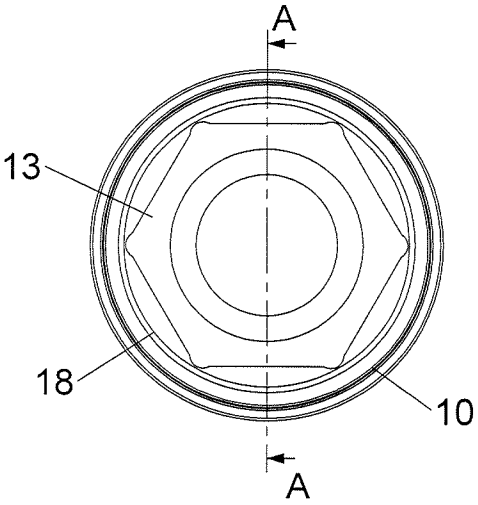
FIG. 2 is a front view of the first part of the tubular tool of the present invention.

Referring to FIGS. 1 to 8, the tubular tool of the present invention comprises a tubular first part 10 and a tubular second part 20. The tubular first part 10 includes a first section 100 and a second section 102 which is located opposite to the first section 100. The first section 100 has an engaging hole 13 defined in the distal end thereof, and the second section 102 has a connection hole 11 defined in the distal end thereof. The connection hole 11 is a polygonal hole which is adapted to be connected with a driving tool, and the engaging hole 13 is a polygonal hole or includes teeth so as to be adapted to be connected with an object. The first part 10 is a socket 30, an adapter or a link. The diameter of the first section 100 is smaller than the diameter of the second section 102. The first diameter 141 of the first outer periphery 14 of the first section 100 is smaller than the second diameter 121 of the second outer periphery 12 of the second section 102. A circular rib group 15 extends outward from the first outer periphery 14 of the first section 100 and circularly extends around the axial line of the tubular first part 10, and the circular rib group 15 is located corresponding to the engaging hole 13. The circular rib group 15 includes two first circular ribs 151, one second circular rib 152 and one third circular rib 153, wherein the two first circular ribs 151 are located close to the engaging hole 13 when compared with the second and third circular ribs 152, 153. The second circular rib 152 is located between the first circular ribs 151 and the third circular rib 153. The shortest distance D1 between the second circular rib 152 and the two first circular ribs 151 is larger than the shortest distance D2 between the second circular rib 152 and the third circular rib 153 (Referring to FIG. 6). The outer diameter 154 of each of the first circular ribs 151, the second circular rib 152 and the third circular rib 153 is larger than the first diameter 141 of the first outer periphery 14 of the first section 100. The top width 155 of the second circular ribs 152 is larger than that of the first and third circular ribs 151, 153. A passage 16 is defined axially through the third section 101 and communicates with the connection hole 11 and the engaging hole 13. The first diameter 141 of the first outer periphery 14 of the first section 100 and the second diameter 121 of the second outer periphery 12 of the second section 102 is larger than the third diameter 171 of the third outer periphery 17 of the third section 101. A stop portion 18 extends outward from a conjunction between the first outer periphery 14 of the first section 100 and the third outer periphery 17 of the third section 101. The fourth diameter 181 of the fourth outer periphery 180 of the stop portion 18 is larger than that of each of the first section 100 and the third section 101. The fourth diameter 181 of the fourth outer periphery 180 of the stop portion 18 is larger than the outer diameter 154 of each of the first circular ribs 151, the second circular rib 152 and the third circular rib 153.

Figure 8:
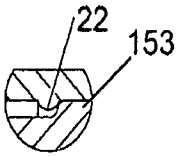
FIG. 8 is an enlarged view of the area "C" in FIG. 6.
Figure 7:
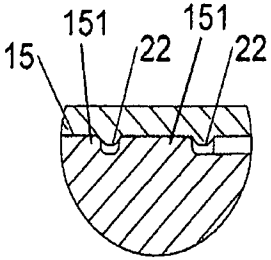
FIG. 7 is an enlarged view of the area "B" in FIG. 6.
Figure 6:
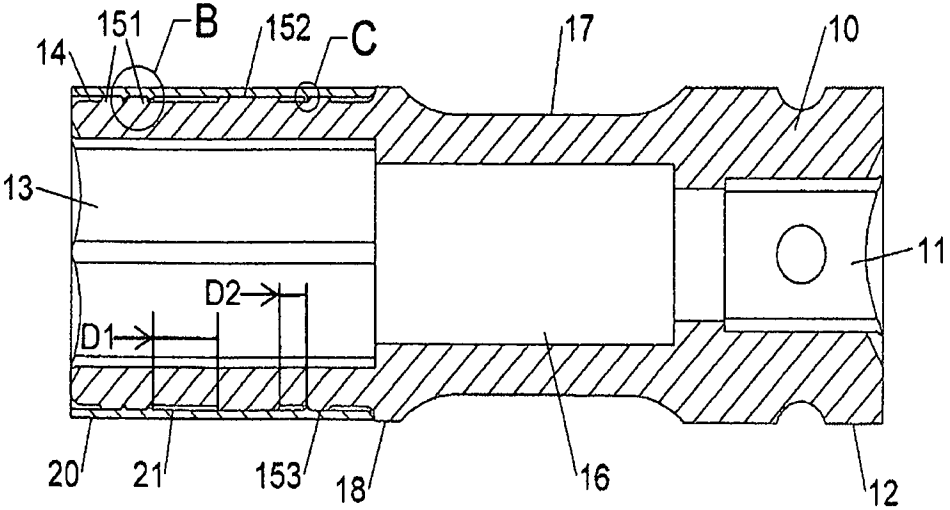
FIG. 6 is a cross sectional view, taken along line A-A of FIG. 5.
Figure 5:
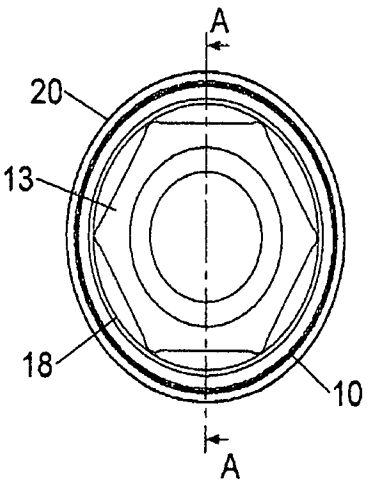
FIG. 5 is a front view of the tubular tool of the present invention.

The tubular second part 20 having a mounting hole 21 defined axially therethrough. The tubular second part 20 is rotatably mounted to the first outer periphery of the first section 100 and stopped by the stop portion 18. Three lips 22 extend inward from the inner periphery of the tubular second part 20, and the three lips 22 are loosely engaged with the circular rib group 15 when the tubular second part 20 rotatably mounted to the first outer periphery 14 of the first section 100 of the first part 10, such that the second part 20 is prevented from separating from the first part 10. It is noted that the three lips 22 are loosely engaged with the circular rib group 15. The two of the three lips 22 are in contact with one side of the two first circular ribs 151, and the third lip 22 is in contact with one side of the third circular rib 153, such that the second part 20 is not axially separated from the first part 10. The ratio between a minimum length from the first circular ribs 151 to the distal end of the first section 100 and the axial length of the engaging hole 13 is less than ⅕. Referring to FIGS. 6-8, one end of the tubular second part 20 is in contact with one end of the stop portion 18, each lip 22 has a curved outer periphery on the top thereof, a shortest distance between the two first circular ribs 151 is identical to a width of each lip 22, one lip 22 engages with an edge of one first circular rib 151, and another lip 22 engages with edges of the two first circular ribs 151.

Figure 9:
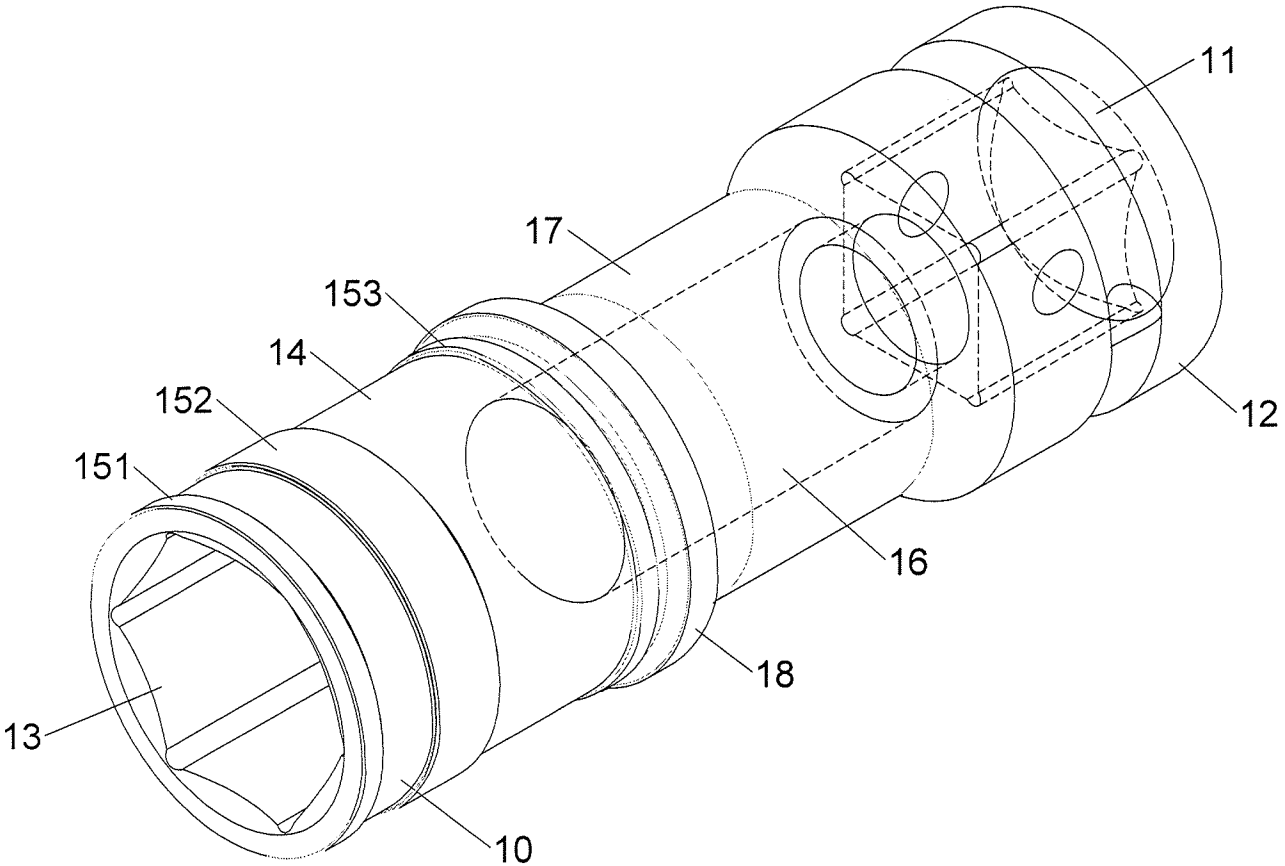
FIG. 9 shows another embodiment of the tubular tool of the present invention.

As shown in FIG. 9, the circular rib group 15 includes one first circular rib 151, one second circular rib 152 and one second circular rib 153.

Figure 10:
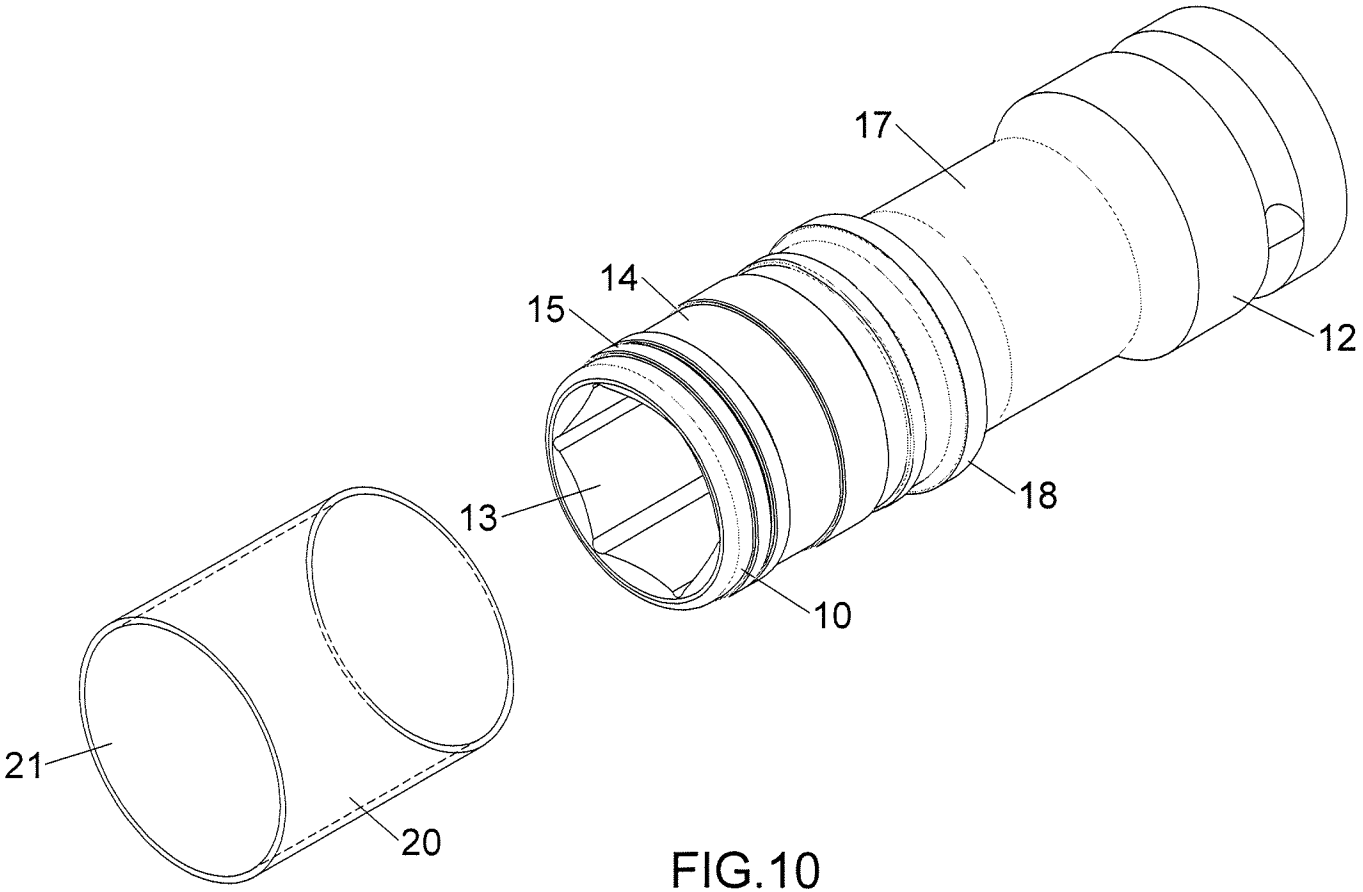
FIG. 10 shows another embodiment of the tubular tool of the present invention.

As shown in FIG. 10, the second part 20 does not have the lip 22. The inner periphery of the mounting hole 21 is tightly engaged with the outer periphery of the circular rib group 15.

Figure 11:
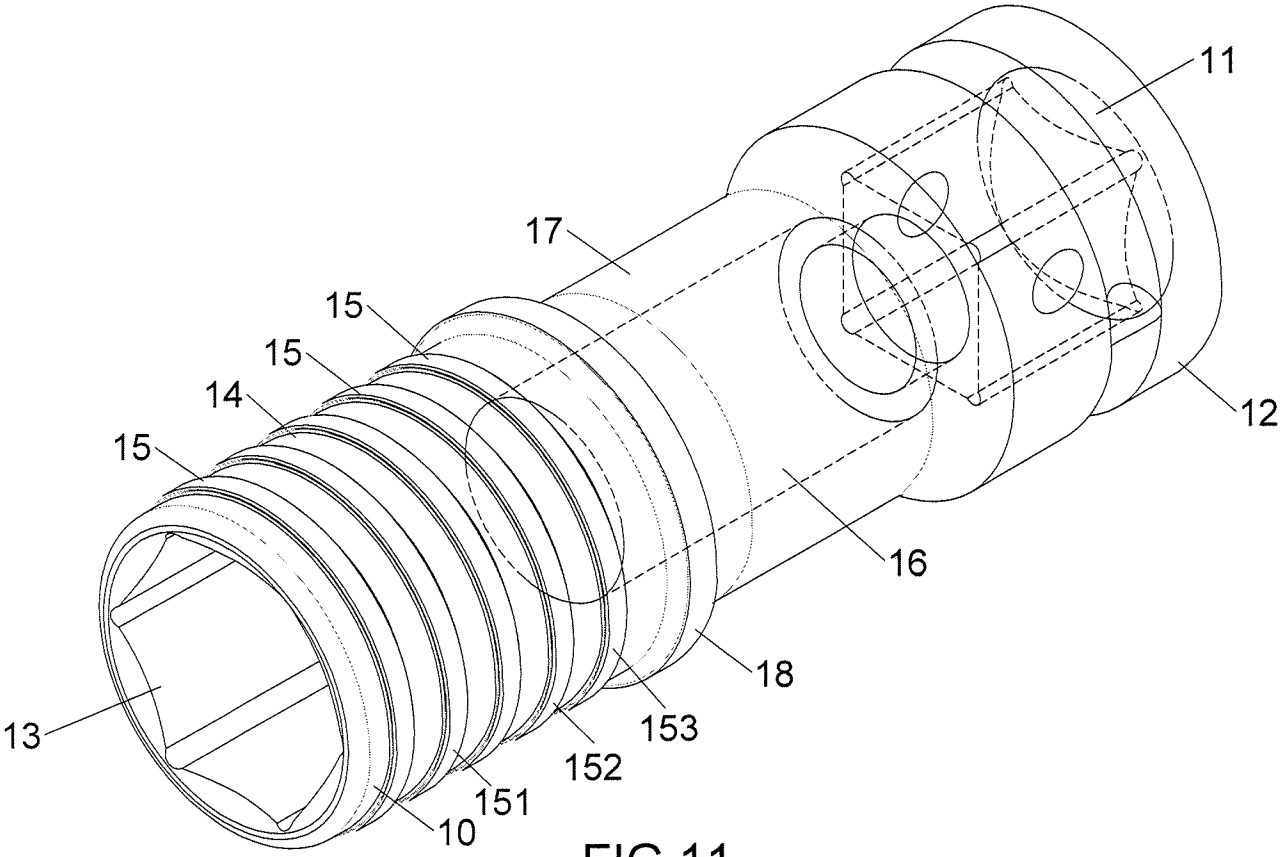
FIG. 11 shows another embodiment of the tubular tool of the present invention.

As shown in FIG. 11, the circular rib group 15 includes three first circular ribs 151, one second circular rib 152 and one second circular rib 153. The distance between the three first circular ribs 151 is identical, and the shape of the three first circular ribs 151 is identical.

Figure 12:
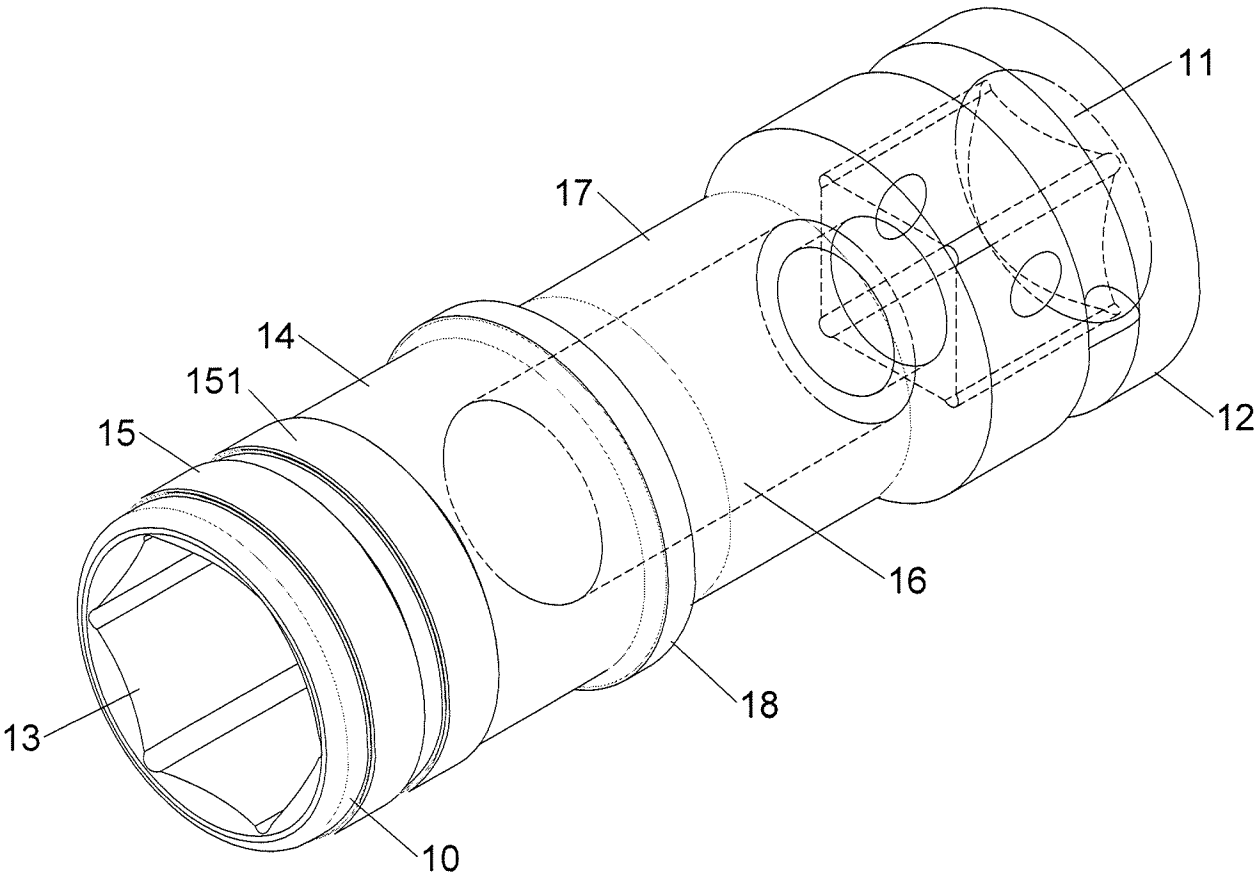
FIG. 12 shows another embodiment of the tubular tool of the present invention.

As shown in FIG. 12, the circular rib group 15 includes two first circular ribs 151, wherein the top width 155 of each first circular rib 151 is larger than at least two times of the distance between the two first circular ribs 151.

Figure 13:
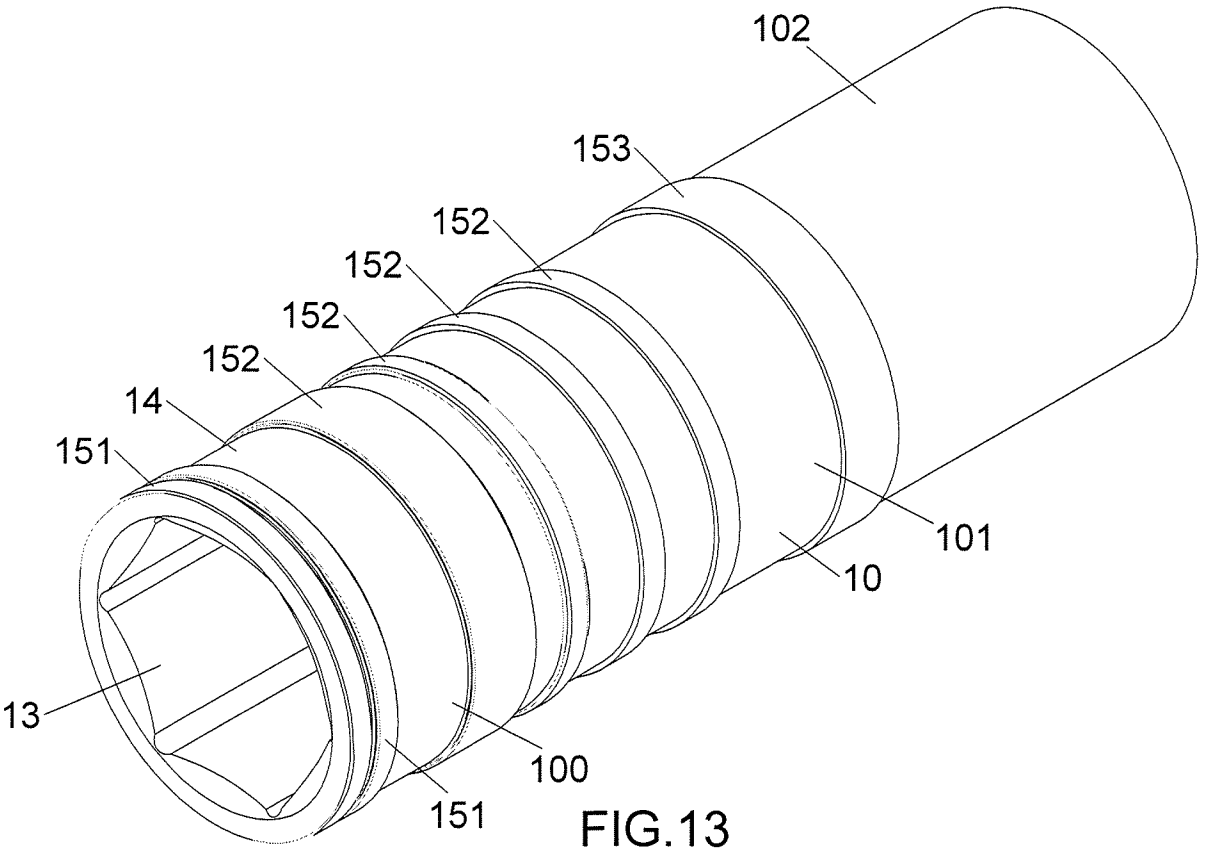
FIG. 13 shows another embodiment of the tubular tool of the present invention.

As shown in FIG. 13, the circular rib group 15 includes two first circular ribs 151, four second circular ribs 152 and one third circular rib 153. Three of the four second circular ribs 152 include an identical top width 155, and the top width 155 of the other one of the four second circular ribs 152 is larger than that of the three of the four second circular ribs 152. The first, second, third and fourth diameters 141, 121, 171, 181 of the first outer periphery 14, the second outer periphery 12, the third outer periphery 13 and the fourth outer periphery 18 are identical.

Figure 14:
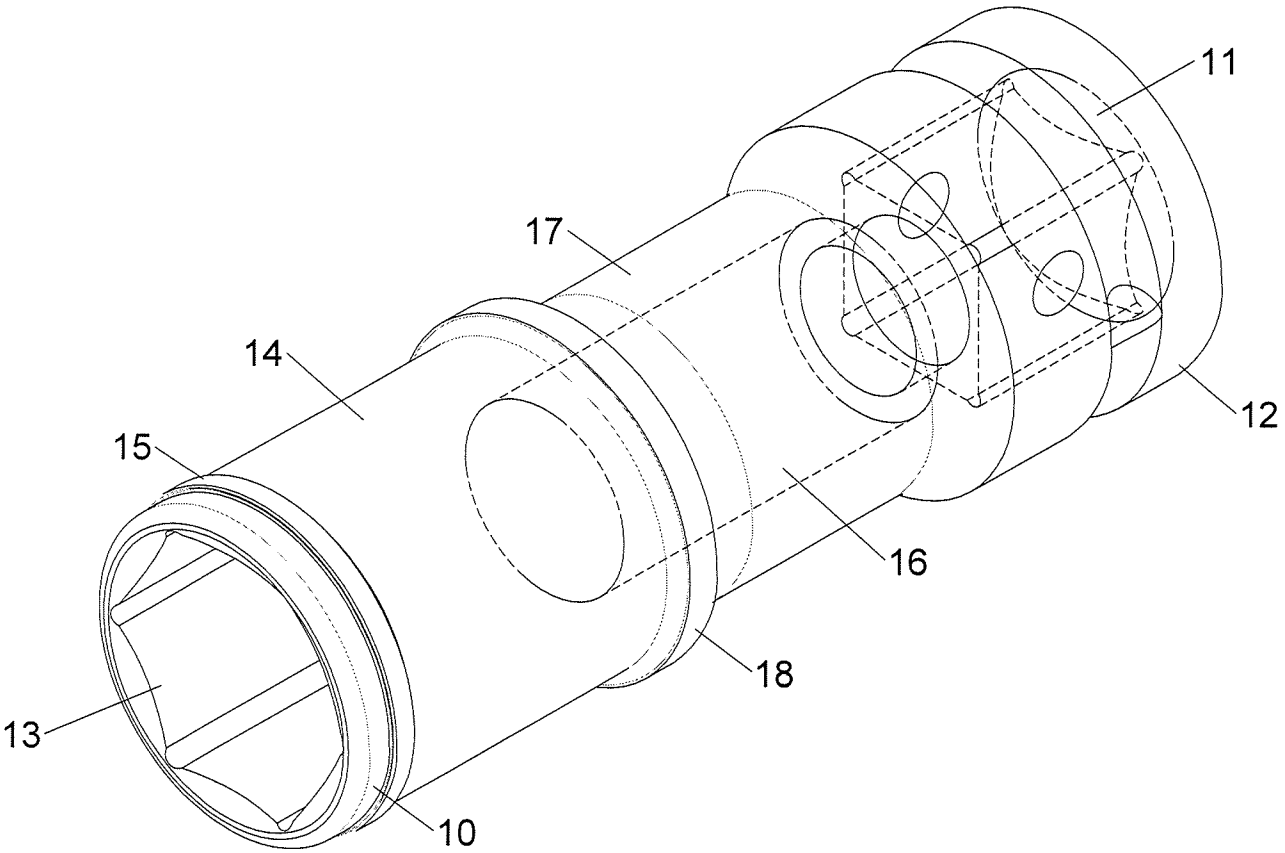
FIG. 14 shows another embodiment of the tubular tool of the present invention.

As shown in FIG. 14, the circular rib group 15 includes one rib 151 that is located close to the opening of the engaging hole 13.

Figure 15:
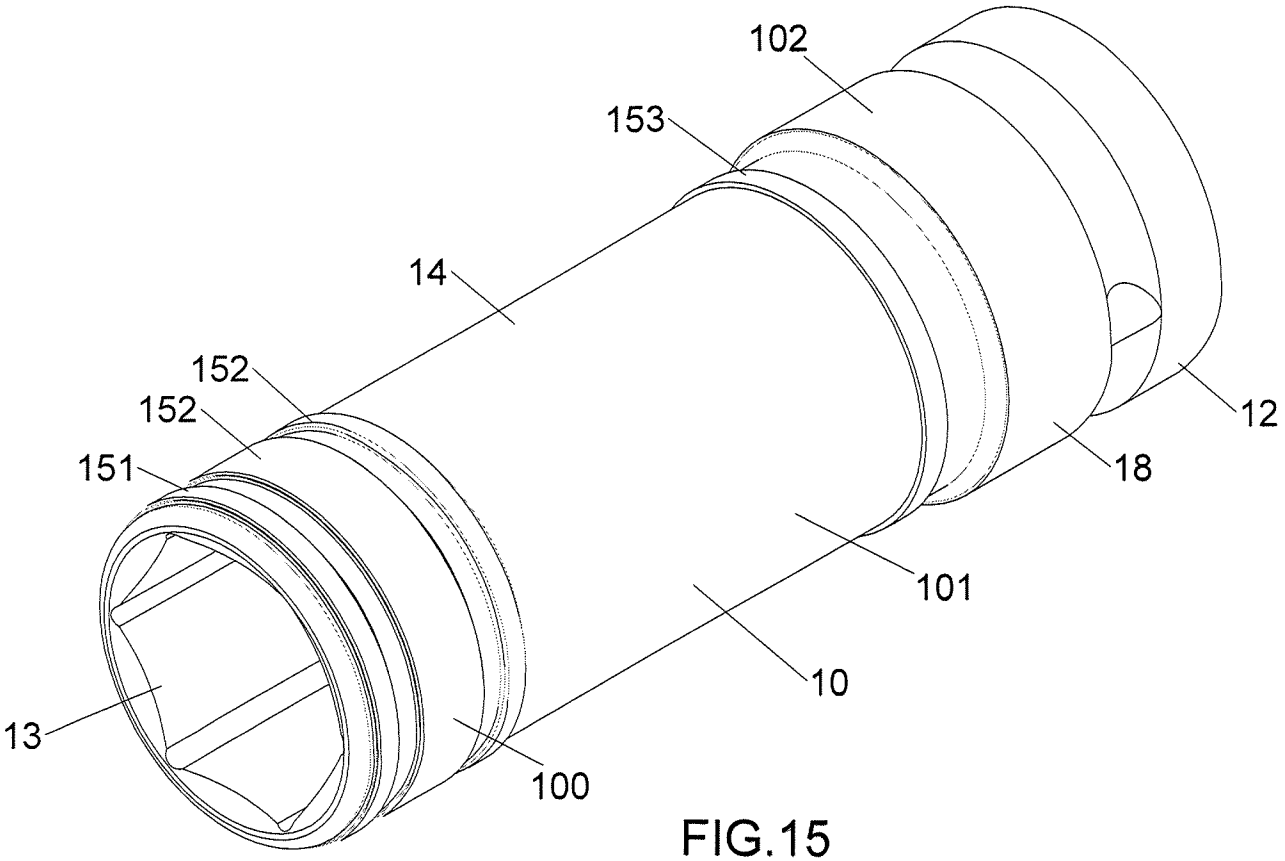
FIG. 15 shows another embodiment of the tubular tool of the present invention.

As shown in FIG. 15, the circular rib group 15 includes one rib 151, one third circular rib 153 and two second circular ribs 152. The first diameter 141 of the first outer periphery 14 is smaller than the second diameter 121 of the second outer periphery 12. The top width of one of the two second circular ribs 152 that is located close to the first circular rib 151 is larger than the top width of another one of the two second circular ribs 152 that is located close to the third circular rib 153. The top width of the second circular rib 152 that is located close to the third circular rib 153 is identical with that of the first circular rib 151.

Figure 16:
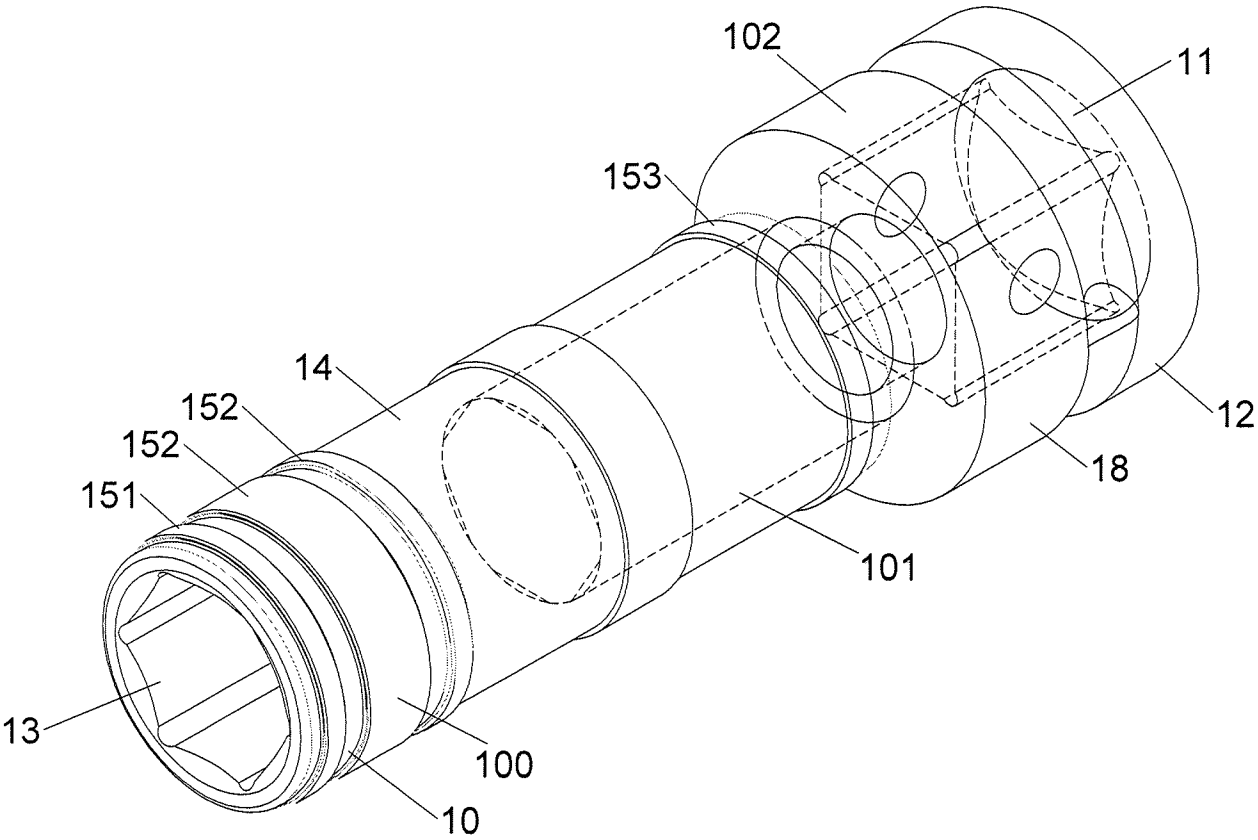
FIG. 16 shows another embodiment of the tubular tool of the present invention.

As shown in FIG. 16, the circular rib group 15 includes one first circular rib 151, three second circular ribs 152 and one third circular rib 153. The top width of the second circular rib 152 that is located at middle of the three second circular ribs 152 is smaller than that of the other two of the three second circular ribs 152.

Figure 17:
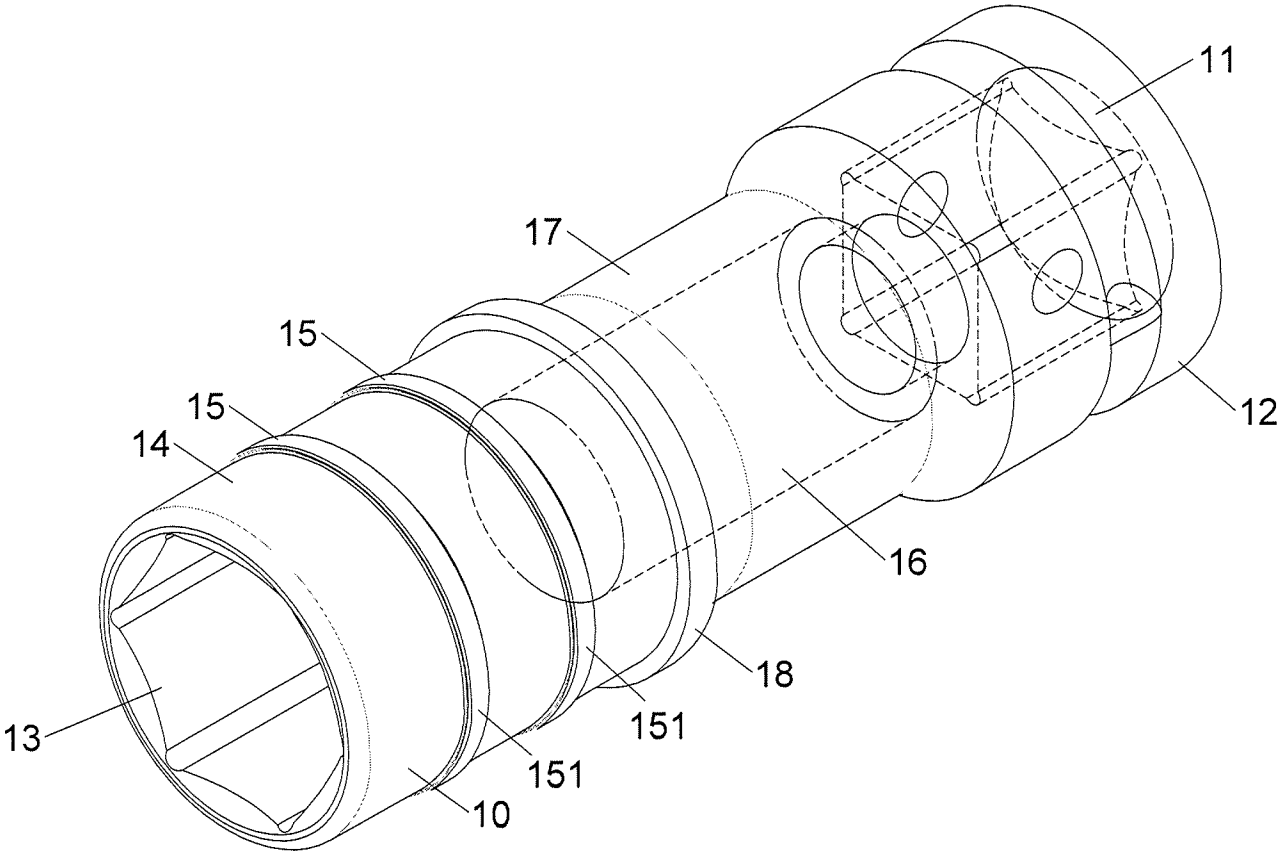
FIG. 17 shows another embodiment of the tubular tool of the present invention.

As shown in FIG. 17, the circular rib group 15 includes two first circular ribs 151, and the two first circular ribs 151 are separated at an equal distance from each other. The two first circular ribs 151 extend from the first outer periphery 14.

Figure 18:
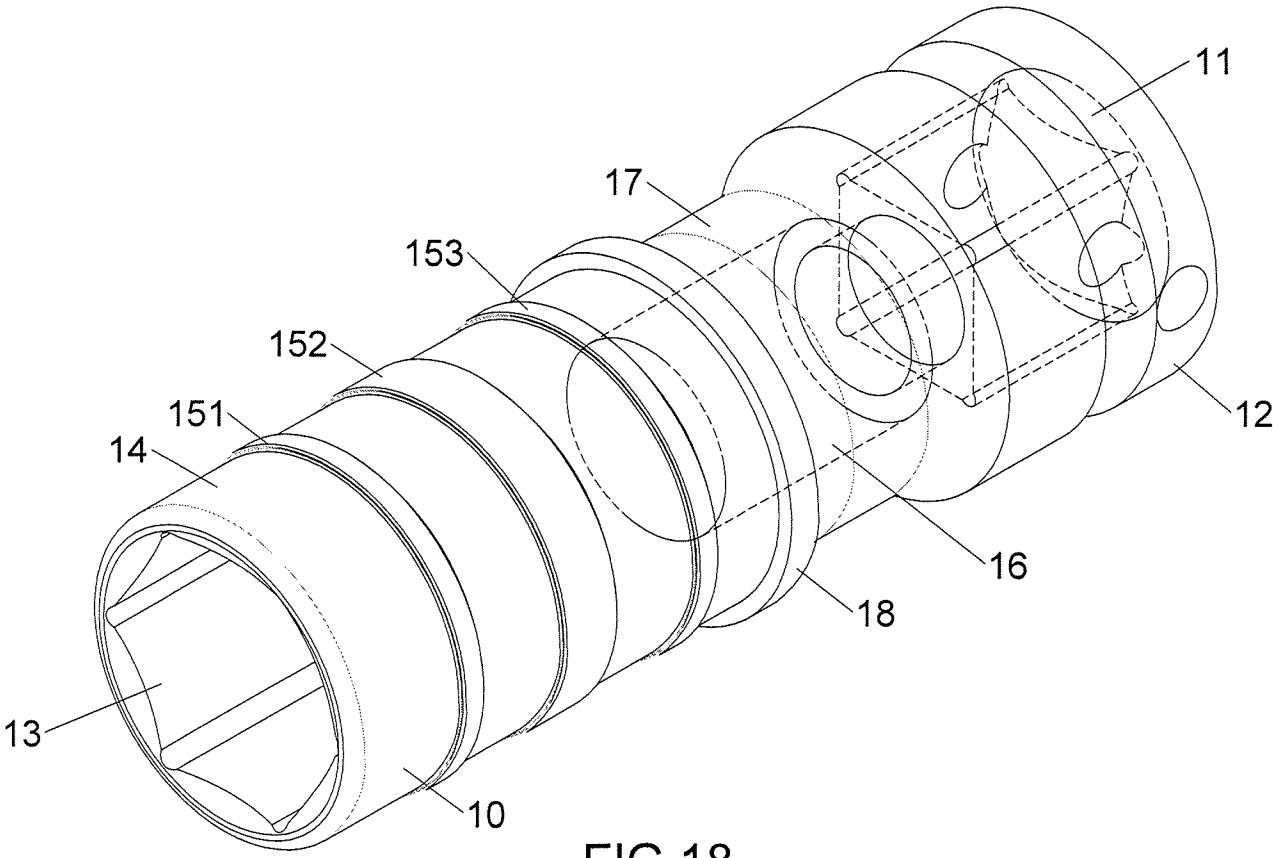
FIG. 18 shows another embodiment of the tubular tool of the present invention.

As shown in FIG. 18, the circular rib group 15 includes one first circular rib 151, one second circular rib 152 and one third circular rib 153. The top width of the second circular rib 152 is larger than that of the first circular rib 151 and the third circular rib 153.

Figure 19:
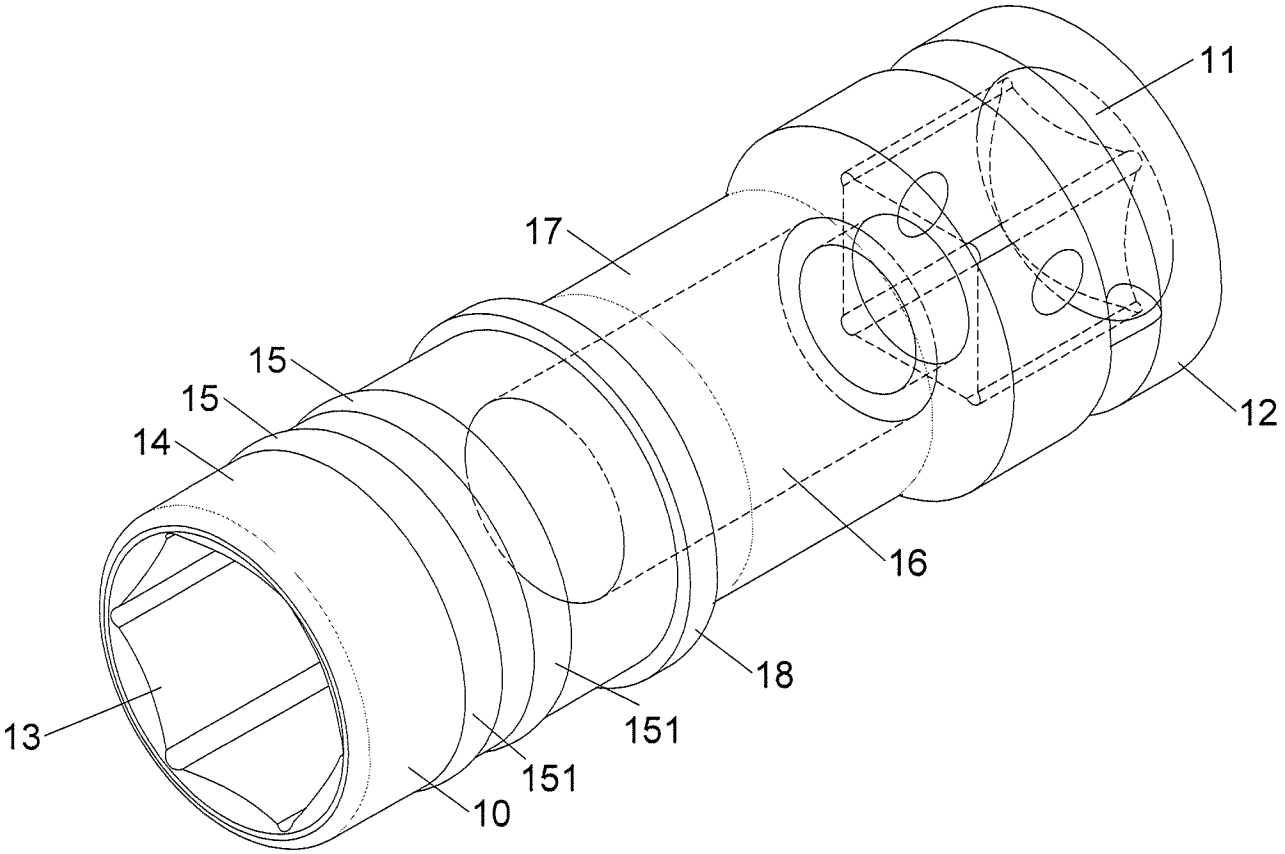
FIG. 19 shows another embodiment of the tubular tool of the present invention.

As shown in FIG. 19, the circular rib group 15 includes two first circular ribs 151 extending from the first outer periphery 14, and the two first circular ribs 151 have an identical shape and a curved outer periphery on the top thereof.

Figure 20:
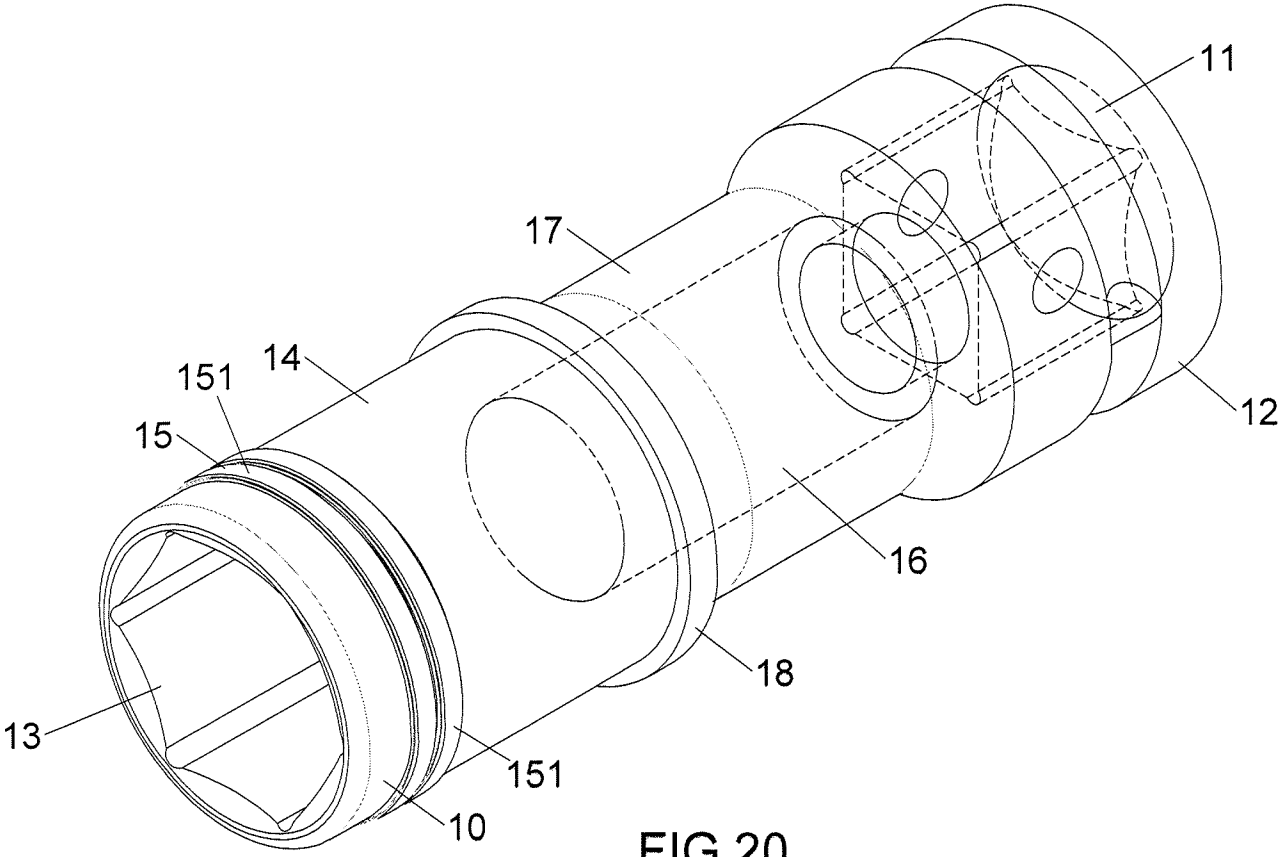
FIG. 20 shows another embodiment of the tubular tool of the present invention.

As shown in FIG. 20, the circular rib group 15 includes two first circular ribs 151 that are located on the first outer periphery 14 and close to the engaging hole 13.

Figure 21:
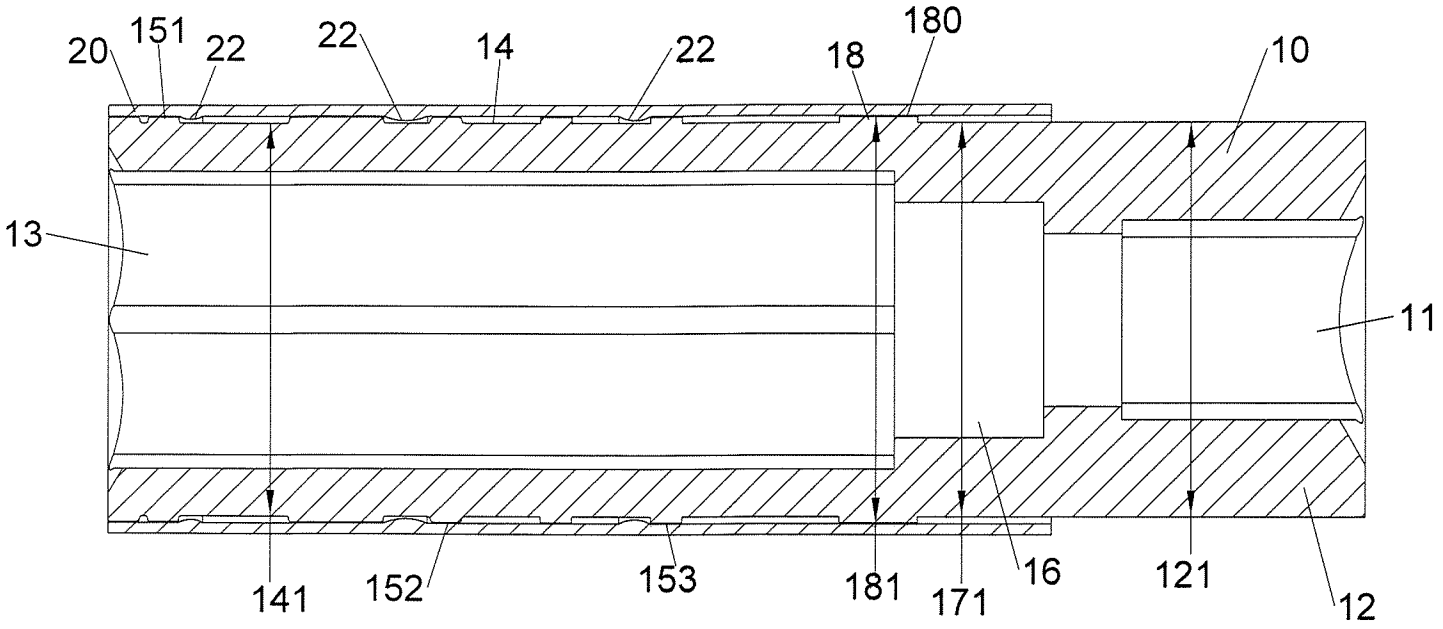
FIG. 21 shows another embodiment of the tubular tool of the present invention.

As shown in FIG. 21, the first, second, third and fourth diameters 141, 121, 171, 181 are identical. The inner periphery of the mounting hole 21 contacts the top of each of the first circular ribs 151, the second circular ribs 152, the third circular ribs 153 and the stop portion 18.

Figure 22:
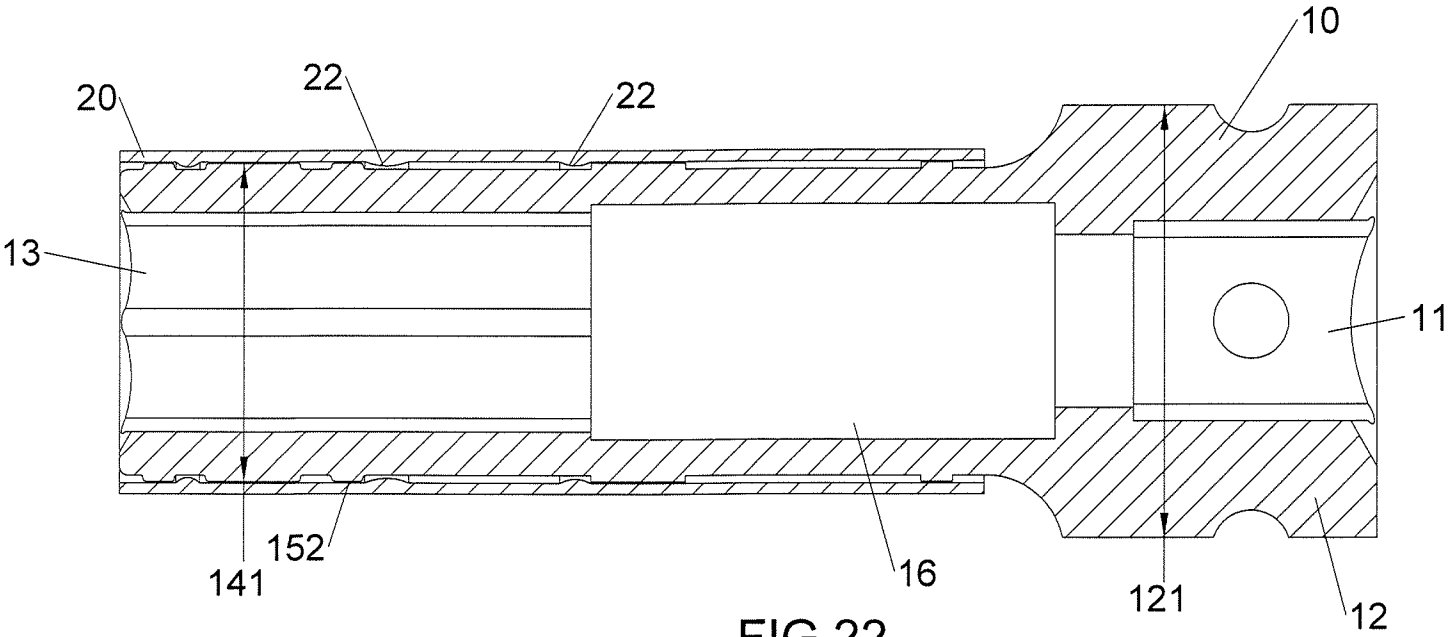
FIG. 22 shows another embodiment of the tubular tool of the present invention.
Figure 23:
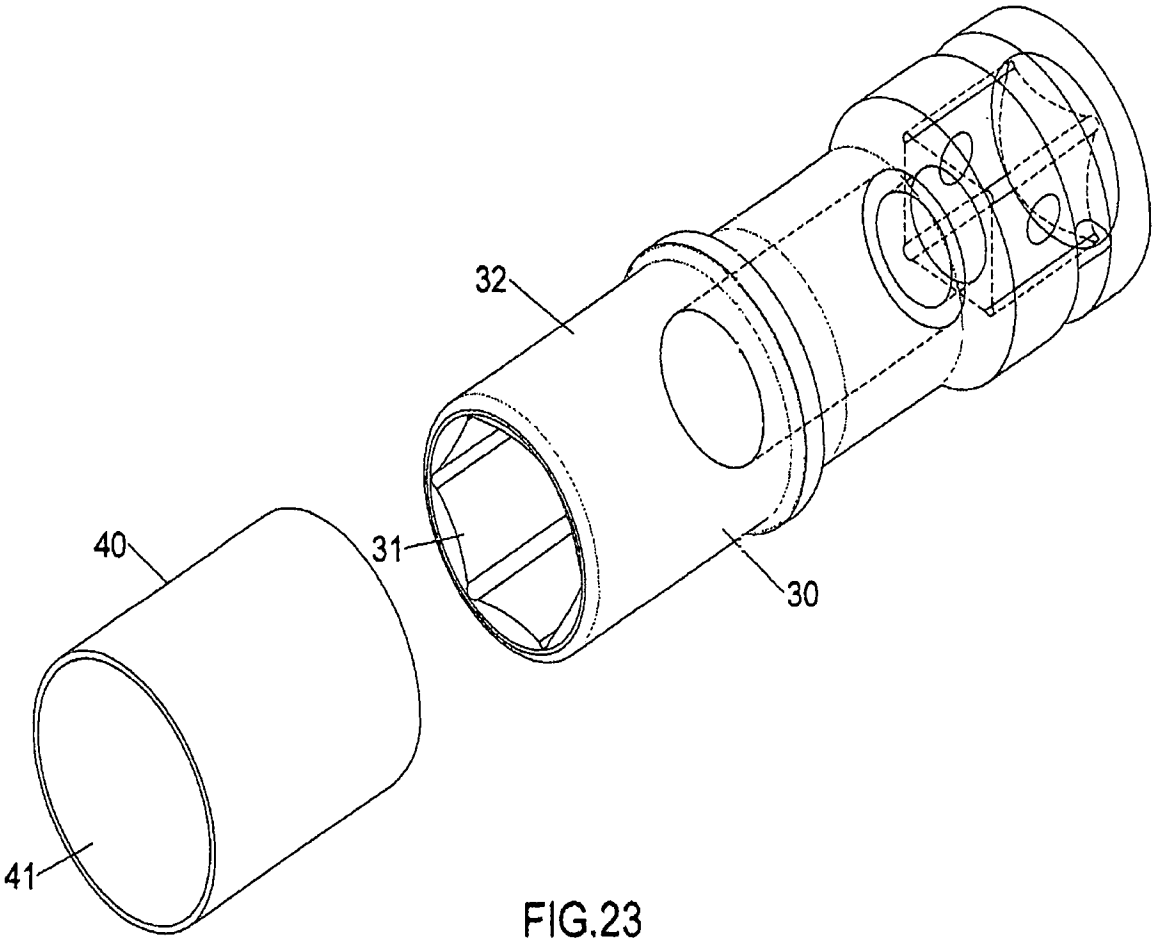
FIG.23 PRIOR ART
FIG. 23 is an exploded view of a conventional tubular tool.

As shown in FIG. 22, the second diameter 121 is larger than the first diameter 141. The inner periphery of the mounting hole 21 contacts the top of the first circular rib 151, the second circular rib 152, the third circular rib 153 and the stop portion 18.

The first part 10 is a socket 30, an adapter or a link.

The advantages of the present invention are that the circular rib group 15 is located corresponding to the engaging hole 13 to reinforce the strength of the portion that the engaging hole 13 is located so as to prolong the life of the first part 10.

The circular rib group 15 is located close to the opening of the engaging hole 13 to reinforce the strength of the portion that the engaging hole 13 is located. The first diameter 141 is reduced to reduce the weight of the tubular tool while the tubular tool still has satisfied strength.

The number, the distance and the top width of the circular rib group 15 can be adjusted according to practical use, for example to be connected with a handle tool, an electric tool or a pneumatic tool.

The circular rib group 15 includes first circular ribs 151, second circular ribs 152 and third circular ribs 153. The number of the first, second and third circular ribs 151, 152, 153, and the distance and the top width of the first, second and third circular ribs 151, 152, 153 can be adjusted according to practical use, for example to be connected with a handle tool, an electric tool or a pneumatic tool.

The number and positions of the lips 22 of the second part 20 are correspondent to the group rib 15 so that the group rib 15 is engaged with the lips 22.

The group rib 15 of the first part 10 is engaged with the lips 22 of the second part 20. The inner periphery of the second part 20 is loosely mounted to the outer periphery of the first part 10 so that the second part 20 is rotatable relative to the first part 10. The users hold the outer periphery of the second part 20 to operate the tubular tool, and do not in contact with the first part 10.

While we have shown and described the embodiment in accordance with the present invention, it should be clear to those skilled in the art that further embodiments may be made without departing from the scope of the present invention.

What is claimed is:

1. A tubular tool comprising:

a tubular first part including a first section and a second section which is located opposite to the first section, the first section having an engaging hole defined in a distal end thereof, the second section having a connection hole defined in a distal end thereof; the connection hole being adapted to be connected with a driving tool, the engaging hole being adapted to be connected with an object, the driving tool rotating the object through the tubular first part of the tubular tool; two first circular ribs, at least one second circular rib and at least one third circular rib respectively extending outward from a first outer periphery of the first section and located corresponding to the engaging hole, the at least one second circular rib being located between the two first circular ribs and the at least one third circular rib; a top width of each of the two first circular ribs being larger than at least two times of a distance between the two first circular ribs; an outer diameter of the first section being smaller than that of the second section, and a tubular second part having a mounting hole defined axially therethrough, two lips extending inward from an inner periphery of the tubular second part, the tubular second part rotatably mounted to the first outer periphery of the first section of the first part, the two lips engaged with the two first circular ribs correspondingly to restrict the second part from separating from the first part, and outer peripheries of the two first circular ribs, the at least one second circular rib and the at least one third circular rib are respectively in contact with an inner periphery of the mounting hole.

2. The tubular tool as claimed in claim 1, wherein the first part is a socket, an adapter or a link, the connection hole is a polygonal hole, the engaging hole is a polygonal hole or includes teeth.

3. The tubular tool as claimed in claim 1, wherein a ratio between a minimum length from the two first circular ribs to the distal end of the first section and an axial length of the engaging hole is less than ⅕.

4. The tubular tool as claimed in claim 1, wherein a shortest distance between the at least one second circular rib and the two first circular ribs is different from a shortest distance between the at least one second circular rib and the at least one third circular rib, top widths of each of the two first circular ribs, the at least one second circular rib and the at least one third circular ribs are different from each other.

5. The tubular tool as claimed in claim 1, wherein a shortest distance between the two first circular ribs and the at least one second circular rib is identical with a shortest distance between the at least one second circular rib and the at least one third circular rib, top widths of each of the two first circular ribs, the at least one second circular rib and the at least one third circular ribs are identical.

6. The tubular tool as claimed in claim 1, wherein there are three lips which are engaged with the two first circular ribs and the at least one third circular rib correspondingly.

7. The tubular tool as claimed in claim 1, wherein there are four second circular ribs and one third circular rib, three of the four second circular ribs include an identical top width, and a top width of the other one of the four second circular ribs is larger than that of the three of the four second circular ribs.

8. The tubular tool as claimed in claim 1, wherein a third section is formed between the first section and the second section, a passage is defined axially through the third section and communicates with the connection hole and the engaging hole, a first diameter of a first outer periphery of the first section and a second diameter of a second outer periphery of the second section is larger than a third diameter of a third outer periphery of the third section.

9. The tubular tool as claimed in claim 8, wherein a stop portion extends outward from a conjunction between the first outer periphery of the first section and the third outer periphery of the third section, a fourth diameter of a fourth outer periphery of the stop portion is larger than that of each of the first section and the third section.

10. The tubular tool as claimed in claim 9, wherein one end of the tubular second part is in contact with one end of the stop portion.

11. The tubular tool as claimed in claim 1, wherein each of the at least two lips has a curved outer periphery on the top thereof.

12. The tubular tool as claimed in claim 1, wherein a shortest distance between the two first circular ribs is identical to a width of each of the at least two lips, one of the at least two lips engages with an edge of one of the first circular ribs, and another of the at least two lips engages with edges of the two first circular ribs.

* * * * *